US009408423B2

(12) United States Patent
Guerra

(10) Patent No.: US 9,408,423 B2
(45) Date of Patent: Aug. 9, 2016

(54) IMPACT REDUCING SPORT EQUIPMENT

(71) Applicant: David A. Guerra, Calgary (CA)

(72) Inventor: David A. Guerra, Calgary (CA)

( * ) Notice: Subject to any disclaimer, the term of this patent is extended or adjusted under 35 U.S.C. 154(b) by 77 days.

(21) Appl. No.: 14/496,962

(22) Filed: Sep. 25, 2014

(65) Prior Publication Data

US 2016/0088884 A1 Mar. 31, 2016

(51) Int. Cl.

| | |
|---|---|
| ***A41D 13/015*** | (2006.01) |
| ***A42B 3/06*** | (2006.01) |
| ***A42B 3/00*** | (2006.01) |
| ***A42B 3/04*** | (2006.01) |

(52) U.S. Cl.

CPC ..... *A41D 13/0156* (2013.01); *A42B 3/00* (2013.01); *A42B 3/04* (2013.01); *A42B 3/06* (2013.01); *A42B 3/064* (2013.01)

(58) Field of Classification Search

CPC ..... A41D 13/0156; A32B 3/00; A32B 3/04; A32B 3/06; A32B 3/124; A32B 3/10; A32B 3/062; A32B 3/0486; A32B 3/063; A32B 3/064; A32B 3/605

USPC ..... 2/411

See application file for complete search history.

(56) References Cited

U.S. PATENT DOCUMENTS

| | | | | | |
|---|---|---|---|---|---|
| 1,997,187 | A * | 4/1935 | Taylor | A42B 3/00 | 2/411 |
| 2,123,275 | A * | 7/1938 | Dym | A42B 3/06 | 2/412 |
| 2,194,903 | A * | 3/1940 | Holstein | A42B 3/00 | 2/413 |
| 2,239,946 | A * | 4/1941 | Upchurch, Jr. | A42B 3/0406 | 2/412 |
| 2,312,227 | A * | 2/1943 | Yant | A42B 3/06 | 156/224 |
| 2,657,385 | A * | 11/1953 | Cushman | A41D 13/0155 | 2/24 |
| 2,733,177 | A | 1/1956 | Meyer | | |
| 3,353,187 | A * | 11/1967 | Lastnik | A42B 3/06 | 2/412 |
| 3,577,305 | A * | 5/1971 | Hines et al. | A41D 13/0155 | 2/243.1 |
| 3,755,059 | A | 8/1973 | Calfee | | |
| 4,179,979 | A * | 12/1979 | Cook | F41H 5/0414 | 109/49.5 |
| 4,213,202 | A * | 7/1980 | Larry | A41D 31/005 | 2/456 |
| 4,375,108 | A * | 3/1983 | Gooding | A42B 3/121 | 2/413 |
| 4,412,358 | A * | 11/1983 | Lavender | A42B 3/124 | 2/412 |

(Continued)

FOREIGN PATENT DOCUMENTS

| | | |
|---|---|---|
| RU | 2112411 C1 | 6/1998 |
| RU | 2213512 C1 | 10/2003 |
| RU | 2378961 C1 | 1/2010 |

*Primary Examiner* — Shaun R Hurley
*Assistant Examiner* — Bao-Thieu L Nguyen
(74) *Attorney, Agent, or Firm* — David A. Guerra

(57) ABSTRACT

A sport equipment for absorbing and dispersing, at least in part, an impact force, thereby reducing the impact force. The sport equipment can be a helmet having an outer shell, an inner shell, and a tensile sheet located between the outer and inner shells. The outer shell includes an interior side featuring a plurality of outer shell detents extending out therefrom. The inner shell includes an exterior side featuring a plurality of inner shell detents extending toward the outer shell. The tensile sheet is configured to dissipate and redirect, randomly directed impact force applied to the outer shell, to a tensile loading directed along a respective longitudinal axis of the tensile sheet. The outer and inner shells are in a spaced apart relationship with and movable to each other. The outer shell detents extend toward the inner shell.

20 Claims, 3 Drawing Sheets

(56) References Cited

U.S. PATENT DOCUMENTS 4,472,472 A * 9/1984 Schultz ..... A41D 31/005 2/410
4,484,364 A * 11/1984 Mitchell ..... A42B 3/124 2/413
4,564,959 A * 1/1986 Zahn ..... A42B 3/065 2/184.5
4,566,137 A 1/1986 Gooding
4,985,931 A * 1/1991 Wingo, Jr. ..... A41D 13/0156 2/268
5,014,366 A * 5/1991 Discipio, Sr. ..... A42B 3/061 2/410
5,030,501 A * 7/1991 Colvin ..... B32B 3/12 206/522
5,034,998 A * 7/1991 Kolsky ..... A41D 13/0155 2/22
5,274,846 A * 1/1994 Kolsky ..... A41D 13/0156 2/16
5,349,702 A * 9/1994 Runckel ..... A42B 1/12 2/171
5,654,518 A * 8/1997 Dobbs ..... F41H 5/0457 109/49.5
5,903,920 A 5/1999 Granqvist
5,940,991 A * 8/1999 Cabalquinto ..... A42B 3/063 36/115
6,063,716 A 5/2000 Granqvist
6,070,905 A * 6/2000 Renault ..... B60R 13/02 280/751
6,122,785 A * 9/2000 Bondie ..... A42B 3/121 5/655.3
6,317,896 B1 * 11/2001 Timms ..... A42B 3/08 2/411
6,378,140 B1 * 4/2002 Abraham ..... A42B 3/064 2/411
6,446,270 B1 * 9/2002 Durr ..... A42B 3/061 2/412
6,510,573 B1 * 1/2003 Grabe ..... A47G 9/1027 5/490
6,658,671 B1 * 12/2003 Von Holst ..... A42B 3/12 2/412
6,691,324 B1 * 2/2004 Nakamura ..... A42B 3/00 2/412
6,777,062 B2 * 8/2004 Skaja ..... B32B 3/26 428/143
6,839,910 B2 * 1/2005 Morrow ..... A63B 71/12 2/92
6,931,671 B2 8/2005 Skiba
7,607,179 B2 * 10/2009 Shih ..... A42B 3/20 2/411
7,802,320 B2 * 9/2010 Morgan ..... A42B 3/124 2/411
7,832,023 B2 * 11/2010 Crisco ..... A42B 3/063 2/410
7,904,971 B2 * 3/2011 Doria ..... A42B 3/127 2/410
8,128,165 B2 * 3/2012 Marsden ..... B60N 2/2851 297/216.1
8,438,669 B2 * 5/2013 Turner ..... A41D 13/05 2/22
8,499,366 B2 8/2013 Nimmons et al.
8,615,817 B2 * 12/2013 Phillips ..... A42B 3/064 2/2.5
8,683,617 B2 * 4/2014 Chilson ..... A42B 3/283 2/171.1
8,756,719 B2 * 6/2014 Veazie ..... A42B 3/121 2/411
8,904,584 B2 * 12/2014 Sugano ..... A47C 27/00 5/652
8,955,169 B2 * 2/2015 Weber ..... A42B 3/125 2/410
8,956,711 B2 * 2/2015 Musaefendic ..... B32B 15/08 428/131
8,973,171 B2 * 3/2015 Cleva ..... A42B 3/125 2/181
9,220,311 B1 * 12/2015 Baldi ..... A42B 3/00
2003/0139104 A1 * 7/2003 Arai ..... A42B 3/063 442/35
2003/0140400 A1 * 7/2003 Ho ..... A42B 3/128 2/411
2003/0180517 A1 9/2003 Karall
2003/0200677 A1 * 10/2003 Abraham ..... A42B 3/124 36/27
2005/0067816 A1 * 3/2005 Buckman ..... A41D 13/018 280/730.1
2005/0196592 A1 * 9/2005 Tao ..... B32B 3/28 428/180
2006/0137073 A1 * 6/2006 Crisco ..... A42B 3/063 2/142
2007/0000032 A1 * 1/2007 Morgan ..... A42B 3/128 2/412
2007/0050893 A1 * 3/2007 Krapiva ..... A42B 3/0486 2/413
2007/0148486 A1 6/2007 Musaefendic
2008/0120764 A1 * 5/2008 Sajic ..... A41D 31/005 2/411
2009/0266663 A1 * 10/2009 Lin ..... A42B 3/063 188/372
2010/0000009 A1 * 1/2010 Morgan ..... A42B 3/124 2/414
2010/0005572 A1 * 1/2010 Chaplin ..... A42B 3/285 2/411
2010/0180362 A1 * 7/2010 Glogowski ..... A42B 3/145 2/411
2010/0299812 A1 * 12/2010 Maddux ..... A42B 3/124 2/414
2011/0047678 A1 * 3/2011 Barth ..... A42B 3/124 2/411
2011/0107503 A1 * 5/2011 Morgan ..... A42B 3/124 2/456
2011/0171420 A1 * 7/2011 Yang ..... A41D 13/0156 428/116
2012/0060251 A1 * 3/2012 Schimpf ..... A42B 3/064 2/5
2012/0151664 A1 * 6/2012 Kirshon ..... A42B 3/12 2/413
2012/0175206 A1 * 7/2012 Kanous ..... A47C 27/18 188/377
2012/0198604 A1 * 8/2012 Weber ..... A42B 3/125 2/414
2013/0000015 A1 * 1/2013 Marzec ..... A42B 3/12 2/411
2013/0061371 A1 3/2013 Phipps et al.
2013/0061375 A1 * 3/2013 Bologna ..... A42B 3/122 2/414
2013/0152287 A1 * 6/2013 Cormier ..... A41D 13/0156 2/459
2013/0185837 A1 7/2013 Phipps et al.
2014/0130239 A1 * 5/2014 Preston-Powers ..... A42B 3/285 2/411
2014/0208486 A1 7/2014 Krueger
2015/0157083 A1 * 6/2015 Lowe ..... A42B 3/064 2/412
2015/0164174 A1 * 6/2015 West ..... A42B 3/069 2/414
2015/0264991 A1 * 9/2015 Frey ..... A42B 3/064 2/411
2015/0305427 A1 * 10/2015 Prabhu ..... A42B 3/128 2/412

* cited by examiner

IMPACT REDUCING SPORT EQUIPMENT

BACKGROUND OF THE INVENTION

1. Field of the Invention

The present invention relates to an impact reducing sport equipment for use in connection with absorbing and dispersing, at least in part, an impact force.

2. Description of the Prior Art

The use of protective sport equipment and helmets is known in the prior art. Protective headgear such as helmets has been worn by users to protect from head injuries. Protective helmets have been used for many activities, including for participants in sports, such as but not limited to, football, hockey, baseball, lacrosse, racing, skiing), for commercial activities and for military personnel. Prior art helmets have generally comprised a single layer rigidly secured to the head of a user, or multiple layers including absorbing elements therebetween.

The known impact absorbing helmets are designed to reduce direct impact forces that can mechanically damage an area of contact. Known impact absorbing helmets will typically include padding and a protective shell to reduce the risk of physical head injury. Helmet liners are provided beneath a hardened exterior shell to reduce violent deceleration of the head. These types of protective gear are reasonably effective in preventing injury. Nonetheless, the effectiveness of protective gear remains limited.

While the above-described devices fulfill their respective, particular objectives and requirements, the aforementioned patents do not describe an impact reducing sport equipment that allows absorbing and dispersing, at least in part, an impact force.

Therefore, a need exists for a new and improved impact reducing sport equipment that can be used for absorbing and dispersing, at least in part, an impact force. In this regard, the present invention substantially fulfills this need. In this respect, the impact reducing sport equipment according to the present invention substantially departs from the conventional concepts and designs of the prior art, and in doing so provide an apparatus primarily developed for the purpose of absorbing and dispersing, at least in part, an impact force.

SUMMARY OF THE INVENTION

In view of the foregoing disadvantages inherent in the known types of protective headgear now present in the prior art, the present invention provides an improved impact reducing sport equipment, and overcomes the above-mentioned disadvantages and drawbacks of the prior art. As such, the general purpose of the present invention, which will be described subsequently in greater detail, is to provide a new and improved impact reducing sport equipment and method which has all the advantages of the prior art mentioned heretofore and many novel features that result in an impact reducing sport equipment which is not anticipated, rendered obvious, suggested, or even implied by the prior art, either alone or in any combination thereof.

To attain this, the present invention essentially comprises a sport equipment for absorbing and dispersing, at least in part, an impact force, thereby reducing the impact force. The sport equipment can be a helmet having an outer shell, an inner shell, and a tensile sheet located between the outer and inner shells. The outer shell includes an interior side featuring a plurality of outer shell detents extending out therefrom. The inner shell includes an exterior side featuring a plurality of inner shell detents extending toward the outer shell. The tensile sheet is configured to dissipate and redirect, randomly directed impact force applied to the outer shell, to a tensile loading directed along a respective longitudinal axis of the tensile sheet. The outer and inner shells are in a spaced apart relationship with and movable to each other. The outer shell detents extend toward the inner shell.

The sport equipment can further include at least one fastener configured to pull the outer shell and the inner shell together, and a coupling member connecting a portion of the outer shell to a portion of the inner shell.

The outer shell can also include a plurality of outer shell troughs each adjacent to at least one of the outer shell detents, and the inner shell can also include a plurality of inner shell troughs each adjacent to at least one of the inner shell detents. With each of the outer shell detents configured to contact a first side of the tensile sheet, and each of the inner shell detents configured to contact a second side of the tensile sheet opposite the first side.

The outer shell troughs can be configured to receive a portion of the first side of the tensile sheet and a portion of at least one of the inner shell detents. Additionally, the inner shell troughs can be configured to receive a portion of the second side of the tensile sheet and a portion of at least one of the outer shell detents.

There has thus been outlined, rather broadly, the more important features of the invention in order that the detailed description thereof that follows may be better understood and in order that the present contribution to the art may be better appreciated.

The invention may also include an inflatable member configured to apply pressure against the tensile sheet. The inflatable member can be received in a groove defined adjacent a peripheral edge of the inner shell, with a portion of the inflatable member being configured to extend from the groove and contact the tensile sheet. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved impact reducing sport equipment that has all of the advantages of the prior art protective headgear and none of the disadvantages.

It is another object of the present invention to provide a new and improved impact reducing sport equipment that may be easily and efficiently manufactured and marketed.

An even further object of the present invention is to provide a new and improved impact reducing sport equipment that has a low cost of manufacture with regard to both materials and labor, and which accordingly is then susceptible of low prices of sale to the consuming public, thereby making such impact reducing sport equipment economically available to the buying public.

Still another object of the present invention is to provide a new impact reducing sport equipment that provides in the apparatuses and methods of the prior art some of the advantages thereof, while simultaneously overcoming some of the disadvantages normally associated therewith.

Even still another object of the present invention is to provide an impact reducing sport equipment for absorbing and dispersing, at least in part, an impact force. This allows for converting a portion of an impact force to a tensile force, thereby reducing the impact force.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE INVENTION

Figure 1:
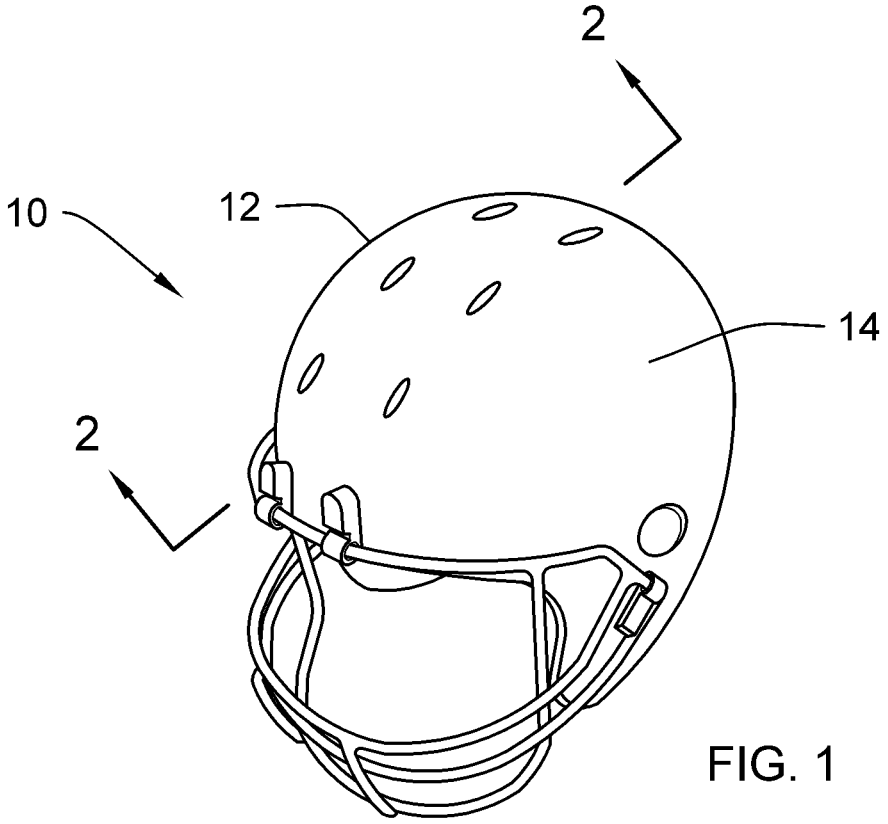
FIG. 1 is a perspective view of an embodiment of the impact reducing sport equipment constructed in accordance with the principles of the present invention, with phantom lines depicting environmental structure and forming no part of the claimed invention.

Referring now to the drawings, and particularly to FIGS. 1-7, an embodiment of the impact reducing sport equipment of the present invention is shown and generally designated by the reference numeral 10.

In FIG. 1, a new and improved impact reducing sport equipment 10 of the present invention for reducing the impact force on sport equipment by dispersing and converting a percentage of the impact force to tension is illustrated and will be described. More particularly, the impact reducing sport equipment 10 can be any sport equipment that receives impact, such as but not limited to, helmets, shoulder protectors, elbow protectors, knee protectors, thigh protectors, hip protectors, shin protectors, wrist protectors, arm protectors, chest protectors, spine protectors, neck protectors, face protectors, torso protectors, and abdomen protectors.

Alternatively, the impact reducing sport equipment 10 can also be sport equipment not worn by a player, such as but not limited to, baseballs, softballs, bats, hockey pucks, hockey sticks, footballs, polo mallets, walls, boards, backboards, goal posts or ground surfaces. The present application will describe, as an example, an embodiment of the present invention as associated with a football helmet 12. However, it can be appreciated that the present invention can be associated with any impact protection equipment. Thus the following exemplary description does not limit the scope of the present invention to helmets.

Figure 2:
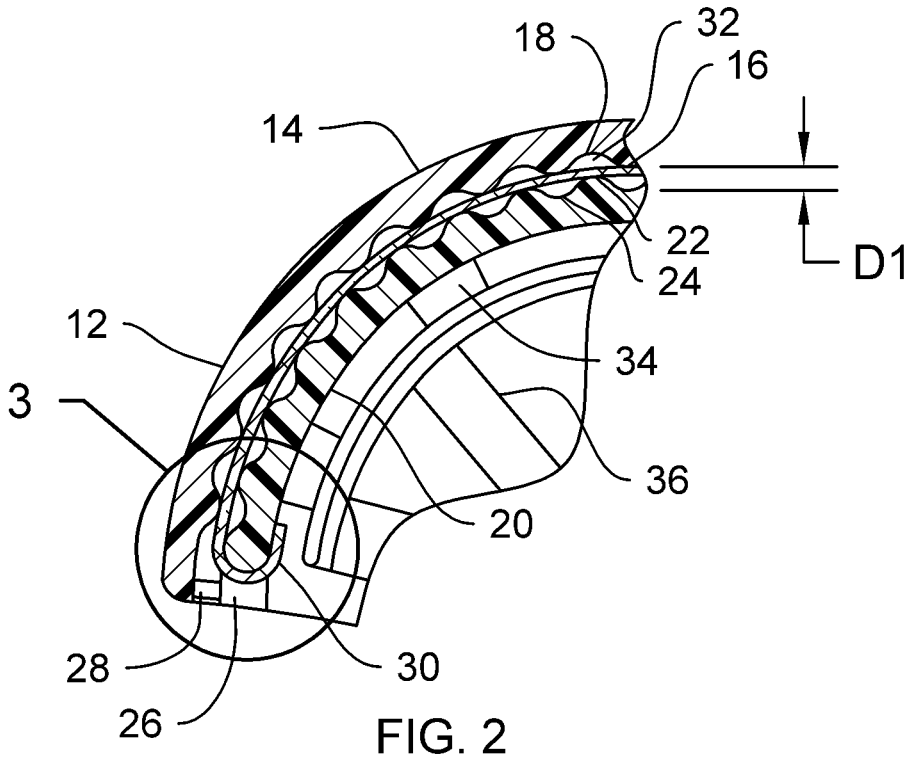
FIG. 2 is a cross-sectional view of the impact reducing sport equipment in a non-impacted state taken along line 2-2 of FIG. 1.

The impact reducing sport equipment 10 can be a helmet 12 having an outer shell 14, an inner shell 20, a tensile sheet 30 between the outer and inner shells, multiple padding or shock absorbing elements 34, and an optional inner liner or harness 36, as best illustrated in FIGS. 1 and 2. It can be appreciated that a face guard and/or chin strips can be removably attached to the helmet 12. Furthermore, vent holes can be defined in the outer and/or inner shells.

The outer shell 14 includes an exterior side and an interior side. The interior side features a plurality of detents 16 extending toward the inner shell 20, and a plurality of troughs 18. The detents 16 can be, but not limited to, concentric ridges and troughs, radially distributed ridges and troughs, a plurality of protrusions or a sinusoidal profile. An apex or tip of the detents 16 can be rounded, squared or any geometric shape.

The inner shell 20 includes an exterior side toward the interior side of the outer shell 14 and an interior side. The exterior side of the inner shell 20 features a plurality of detents 22 extending toward the outer shell 14, and a plurality of troughs 24. The detents 22 can be, but not limited to, concentric ridges and troughs, radially distributed ridges and troughs, a plurality of protrusions or a sinusoidal profile. An apex or tip of the detents 22 can be rounded, squared or any geometric shape. The detents 22 and troughs 24 of the inner shell 20 are offset from the detents 16 and troughs 18 of the outer shell 14, so that the detent 16 of the outer shell 14 is receivable in the trough 24 of the inner shell 20 and the detent 22 of the inner shell 20 is receivable in the trough 18 of the outer shell 14.

The outer shell 14 and inner shell 20 can be made from the same or different materials, such as but not limited to, laminates, plastics, carbon fiber, polycarbonate, polymers, polyethylene, epoxy, metals, composites or alloys.

Figure 3:
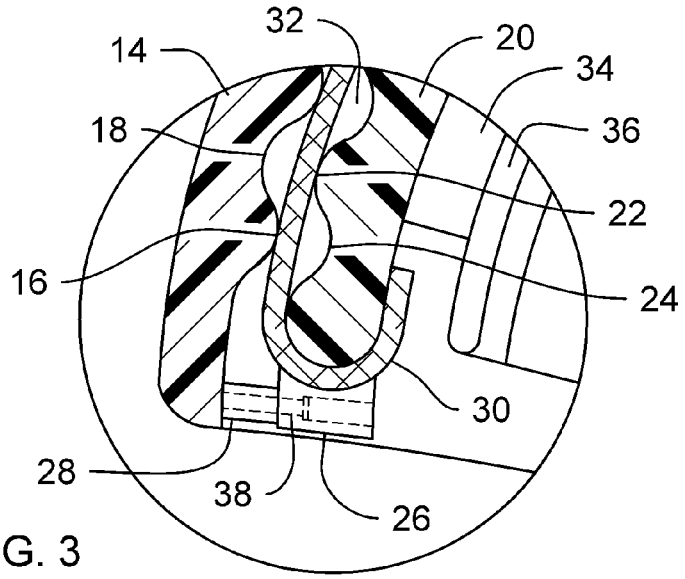
FIG. 3 is an enlarged cross-sectional view of a section of the impact reducing sport equipment of FIG. 2.
Figure 4:
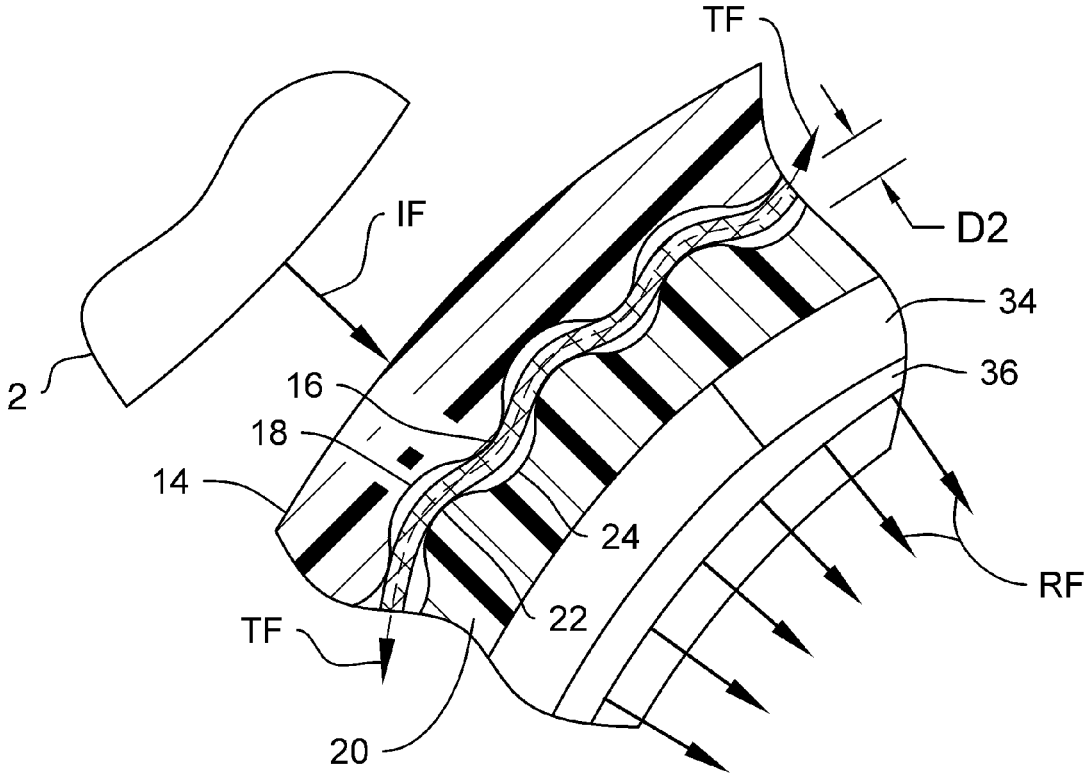
FIG. 4 is an enlarged cross-sectional view of a section of the impact reducing sport equipment in an impacted stated.

The tensile sheet 30 is positioned between the outer shell 14 and inner shell 20, and can be secured at its peripheral edge to either the outer shell 14 of inner shell 20. As an example and as best illustrated in FIG. 3, the tensile sheet 30 is placed over the inner shell 20 and the peripheral edge of the tensile sheet 30 is wrapped around a peripheral edge of the inner shell 20. The peripheral edge of the tensile sheet 30 can then be secured to the interior side of the inner shell 20 so that the tensile sheet 30 is stretched to a predetermined tensile force. The tensile sheet 30 can be, but not limited to, woven, laminated, layered or a fabric made from KEVLAR™ (para-aramid synthetic fiber), TWARON™ (para aramid), TECHNORA™ (aramid), INNAGRA S™ (polyolefin), DYNEEMA™ (Ultra-high-molecular-weight polyethylene), aramid, para aramid, polyamides, Ultra-high-molecular-weight polyethylene (UHMWPE, UHMW), carbon nanotube, graphene, SPECTRA® (Ultra-high-molecular-weight polyethylene), spider silk, carbon/carbon composite, carbon fiber or silicon carbide fiber.

A coupling member 28 is positioned between the outer shell 14 and inner shell 20. The coupling member is configured to join the interior side or edge of the outer shell 14 to the exterior side, an extension or edge 26 of the inner shell 20. The coupling member 28 can be, but not limited to a rigid member, an elastomeric member, a shock absorbing member, a biasing member, an articulating member or a spring member. The coupling member 28 has a predetermined length so as to produce a gap 32 between the outer shell 14 and inner shell 20. It can be appreciated that different sizes of coupling members 28 can be used to produce a predetermine gap 32, which results in different pretension forces on the tensile sheet 30 and to an amount of travel of the outer shell 14 to the inner shell 20.

A fastener 38 can be used to attach or couple the outer shell 14 and inner shell 20, as best illustrated in FIG. 3. The fastener 38 can pass through the coupling member 28 or can be associated at any location so as to pull the outer shell 14 toward the inner shell 20, vice versa. The fastener 38 can also be configured to produce a pretension force to the tensile sheet 30 by compressing the outer shell 14 and inner shell 20 so that the detents 16, 22 stretch the tensile sheet 30. The pretension force can be adjusted by adjusting the clamping force produced by the fastener 38.

As best illustrated in FIG. 2, the helmet 12 is in a pre-impact state where the gap 32 has a first distance D1. It can be appreciated that the gap 32 can be filled with an impact absorbing material, such as but not limited to, elastomers, foams, plastics, rubbers, gels, fluids, gases, polymers, ferrofluids, SORBOTHANE® (visco-elastic polymer), PORON® (urethanes), biasing members, visco-elastics, ethylene vinyl acetate (EVA), neoprene, polyurethane gels, carbon fibers or D30®. The pretension force of the tensile sheet 30 has been predetermined and produced by the tension force of the tensile sheet 30 secured to the inner shell 20, the size of the coupling member 28, the clamping force of the fastener 38 or a combination thereof.

In use, it can now be understood that when a second helmet or object 2 impacts the outer shell 14 of the helmet 12, an impact force IF is produced which pushes the outer shell 14 toward the inner shell 20 to an impacted state having a second distance D2 therebetween. The impact force IF is distributed across multiple detents 16 of the outer shell 14, which travel toward and are received in corresponding troughs 24 of the inner shell 20. Simultaneously, multiple detents 22 of the inner shell 20 travel toward and are received in corresponding troughs 18 of the outer shell 14. The impact force IF is transmitted through related detents 16 of the outer shell 14 to the tensile sheet 30, which stretches the tensile sheet 30. A portion of the impact force IF is converted to a tension force TF radiating through the tensile sheet 30 at the point of impact, thus allowing the tensile sheet 30 to stretch.

The remaining portion of the impact force or resultant force RF, which is less than the initial impact force IF, is transmitted from the tensile sheet 30 to the multiple detents 22 of the inner shell 20 and distributed to an area that is larger than the point of impact. The resultant force RF is further reduced and dispersed by the multiple padding or shock absorbing elements 34, and the inner liner or harness 36.

After impact, the outer shell 14 returns to its pre-impacted state and first distance D1, because the tensile strength returns the tensile sheet 30 to its original shape thus pushing against the detents 16 of the outer shell 14. The tensile sheet 30 is configured to dissipate and redirect the impact force IF applied to the outer shell 14, to a tensile loading directed along a respective longitudinal axis of the tensile sheet 30.

In support of the above-identified claims, the impact force IF absorption and distribution by the tensile sheet 30 can be describes as the following, with the assumption that no fiber breakage occurs under low level of impact energy. When the impact or outer shell detents strikes the tensile sheet 30, the impact force IF can be classified into two quantities. One is the elastic energy which is stored elastically in the tensile sheet and transferred back to the second helmet (impactor) and/or the outer shell detents 16. Another is the absorbed energy which is the sum of the absorbed energy in the tensile sheet and inner shell by its damage initiation and propagation, and the energy absorbed by the impact system in vibration, heat, inelastic behavior of the impactor or supports. Thus, the following relationship described in Equation 1 holds under low velocity, low energy impacts.

$$E_{total}=E_{reb}+E_{abs} \qquad \text{Equation 1}$$

where $E_{reb}$ is the rebound energy, $E_{abs}$ is the absorbed energy, and $E_{total}$ is the total energy. Thus, a portion of the absorbed energy is distributed through the helmet 12 as the tension force TF, prior to the resultant force RF reaching a person wearing the helmet 12.

Two types of waves are formed just after impact which is the sudden local momentum transfer at time t=0. The first type consists of radially growing tensile waves through the tensile sheet, and these are followed by much slower transverse waves in the form of growing cones with the point of impact at their apexes. The impactor, which can be treated as the outer shell detents, is decelerated by the membrane forces generated as the waves propagate in the layers made up by the outer shell, tensile sheet, and inner shell.

It can be appreciated that the size or radius of the detents 16, 22 can be changed to increase or decrease the surface area of the point of contact with the tensile sheet 30 so as to alter the impact force IF distribution to and from the tensile sheet 30. For example, a larger radius of the detents 16, 22 would increase the impact force surface area to and from the tensile sheet 30, thus distributing the impact force IF over a larger area.

Figure 5:
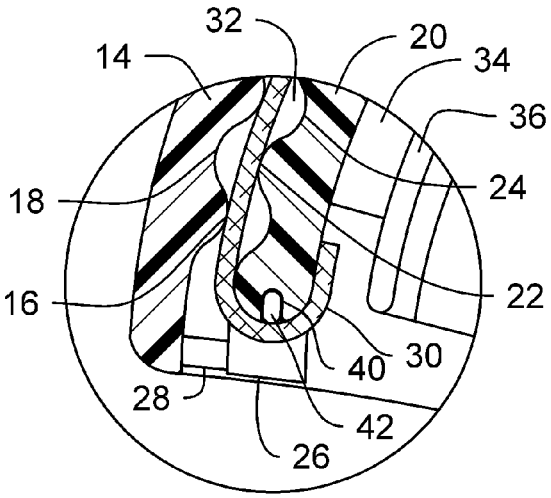
FIG. 5 is an enlarged cross-sectional view of a frontal section of an alternate embodiment inner shell of the impact reducing sport equipment.
Figure 6:
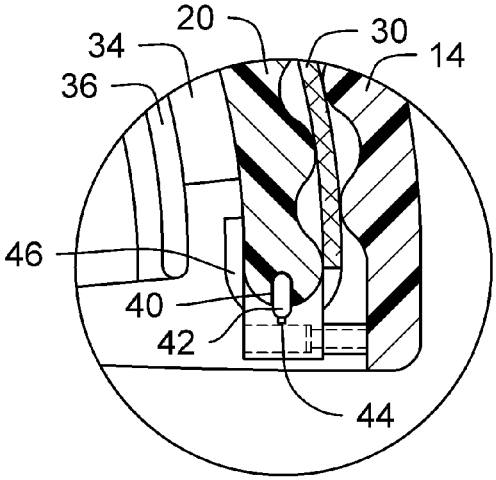
FIG. 6 is an enlarged cross-sectional view of a rear section of the alternate embodiment inner shell of the impact reducing sport equipment.
Figure 7:
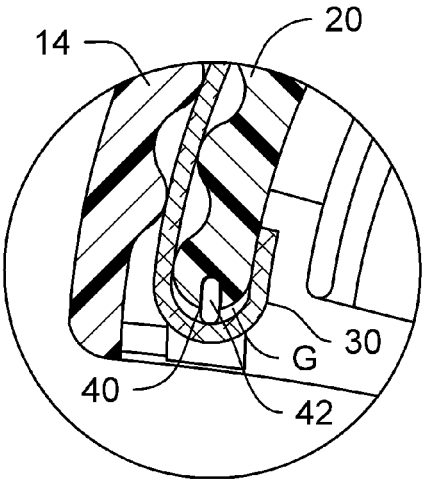
FIG. 7 is an enlarged cross-sectional view of the frontal section of the alternate embodiment inner shell in a tensioned stated.

FIGS. 5-7 reference an alternate embodiment inner shell 20, which includes a groove 40 defined in or near the peripheral edge. An inflatable member 42 is received in the groove 40 interior of the tensile sheet 30. The inflatable member 42 includes a nipple or valve 44 for inflating or deflating the inflatable member 42, as best illustrated in FIG. 6.

In use, the inflatable member 42 can be inflated using the valve 44 so that a portion of the inflatable member 42 expands outside the groove 40. During expansion, the inflatable member 42 will contact an interior side of the tensile sheet 30 and push a corresponding section of the tensile sheet 30 away from the peripheral edge of the inner shell 20, as best illustrated in FIG. 7. This pushing force will produce a gap G between the corresponding section of the tensile sheet 30 and the peripheral edge of the inner shell 20, thus stretching the tensile sheet 30 to produce and control a pretension force on the tensile sheet 30. The pretension force can be adjusted by inflating or deflating the inflatable member 42 a predetermined amount.

It can be appreciated that the inflatable member 42 can be replaced with a tensioning wire that when tightened by a control dial or lever would pull the tensile sheet 30, and thus produce a pretension force.

While embodiments of the impact reducing sport equipment have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. And although absorbing and dispersing, at least in part, an impact force have been described, it should be appreciated that the impact reducing sport equipment herein described is also suitable for any impact absorbing surface.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sport equipment for absorbing and dispersing, at least in part, an impact force, said sport equipment comprising:

an outer shell having an interior side featuring a plurality of outer shell detents extending out therefrom;

an inner shell having an exterior side featuring a plurality of inner shell detents extending toward said interior side of said outer shell, said inner shell being in a spaced apart relationship with said outer shell to define a gap therebetween; and a tensile sheet located between said outer shell and said inner shell, said tensile sheet being configured to dissipate and redirect, randomly directed impact force applied to said outer shell, to a tensile loading directed along a respective longitudinal axis of said tensile sheet;

wherein said outer shell detents extend toward said inner shell;

wherein at least one of said outer shell detents and said inner shell detents featuring sides tapering toward a rounded apex contactable with said tensile sheet.

2. The sport equipment as according to claim 1, wherein said tensile sheet is secured to one of said outer shell, and said inner shell.

3. The sport equipment as according to claim 1 further comprising at least one fastener configured to pull said outer shell and said inner shell together.

4. The sport equipment as according to claim 1 further comprising a coupling member connecting a portion of said outer shell to a portion of said inner shell.

5. The sport equipment as according to claim 4, wherein said coupling member is deformable.

6. The sport equipment as according to claim 5 further comprising at least one fastener configured to pull said outer shell and said inner shell together, said fastener received through said coupling member.

7. The sport equipment as according to claim 1, wherein said outer shell further comprising a plurality of outer shell troughs each adjacent to at least one of said outer shell detents, and said inner shell further comprising a plurality of inner shell troughs each adjacent to at least one of said inner shell detents.

8. The sport equipment as according to claim 7, wherein each of said outer shell detents is configured to contact a first side of said tensile sheet, and each of said inner shell detents is configured to contact a second side of said tensile sheet opposite said first side.

9. The sport equipment as according to claim 8, wherein at least one of said outer shell troughs is configured to receive a portion of said first side of said tensile sheet and a portion of at least one of said inner shell detents, and at least one of said inner shell troughs is configured to receive a portion of said second side of said tensile sheet and a portion of at least one of said outer shell detents.

10. The sport equipment as according to claim 1 further comprising an inflatable member configured to apply pressure against said tensile sheet.

11. The sport equipment as according to claim 10, wherein said tensile sheet wraps around a peripheral edge of said inner shell.

12. The sport equipment as according to claim 11, wherein said inflatable member is received in a groove defined adjacent said peripheral edge of said inner shell, a portion of said inflatable member is configured to extend from said groove and contact said tensile sheet.

13. The sport equipment as according to claim 1, wherein said gap is filled with an impact absorbing material.

14. The sport equipment as according to claim 1, wherein said sport equipment is a helmet.

15. The sport equipment as according to claim 13, wherein said helmet further comprises a plurality of padding attached to an interior side of said inner shell.

16. A sport equipment comprising:

an outer shell having an interior side;

an inner shell having an exterior side in a spaced apart relationship with said interior side of said outer shell to define a gap therebetween; and a tensile sheet located in said gap, said tensile sheet being capable of transforming at least a portion of an impact force applied to one of said outer shell and said inner shell to a tensile loading directed along a respective longitudinal axis of said tensile sheet;

wherein at least one of said outer shell and said inner shell has a plurality of detents extending toward said tensile sheet, and at least one of said outer shell and said inner shell has a plurality of recesses defined adjacent said tensile sheet and configured to receive at least one of said detents, respectively;

wherein at least one of detents features sides tapering toward a rounded apex contactable with said tensile sheet.

17. The sport equipment as according to claim 16, wherein said interior side of said outer shell and said exterior side of said inner shell each has said detents and said recesses.

18. The sport equipment as according to claim 17, wherein said detents each has an apex in contact with said tensile sheet, and wherein said recesses are adjacent said tensile sheet to define an open space in communication with said tensile sheet.

19. The sport equipment as according to claim 18, wherein said open space is filled with an impact absorbing material.

20. A method of using a sport equipment to reduce an impact force applied to said sport equipment, said method comprising the steps of:

a) locating a tensile sheet in a gap defined between an interior side of an outer shell and an exterior side of an inner shell, said exterior side of said inner shell being in a spaced apart relationship with said interior side of said outer shell;

b) moving said outer shell toward said inner shell upon an impact force applied to said outer shell;

c) contacting at least a portion of said tensile sheet with at least a portion of a rounded apex of at least one of a plurality of detents extending from at least one of said outer shell and said inner shell, said detents extending toward said tensile sheet and featuring sides tapering toward said apex;

d) deforming said portion of said tensile sheet by said at least one of said detents toward a recess defined, opposite said at least one of said detents, in at least one of said outer shell and said inner shell, respectively;

e) transforming a first portion of said impact force to a tensile loading directed along a respective longitudinal axis of said tensile sheet; and f) transferring a second portion of said impact force to said inner shell from said tensile sheet.

* * * * *